US008304979B2

(12) United States Patent
Ono et al.

(10) Patent No.: US 8,304,979 B2
(45) Date of Patent: Nov. 6, 2012

(54) LIGHT EMITTING DEVICE HAVING INORGANIC LUMINESCENT PARTICLES IN INORGANIC HOLE TRANSPORT MATERIAL

(75) Inventors: Masayuki Ono, Osaka (JP); Shogo Nasu, Hyogo (JP); Eiichi Satoh, Osaka (JP); Reiko Taniguchi, Osaka (JP); Takayuki Shimamura, Osaka (JP); Masaru Odagiri, Hyogo (JP)

(73) Assignee: Panasonic Corporation, Osaka (JP)

( * ) Notice: Subject to any disclaimer, the term of this patent is extended or adjusted under 35 U.S.C. 154(b) by 223 days.

(21) Appl. No.: 12/746,446

(22) PCT Filed: Dec. 4, 2008

(86) PCT No.: PCT/JP2008/003592

§ 371 (c)(1),
(2), (4) Date: Jun. 4, 2010

(87) PCT Pub. No.: WO2009/072288

PCT Pub. Date: Jun. 11, 2009

(65) Prior Publication Data

US 2010/0283066 A1 Nov. 11, 2010

(30) Foreign Application Priority Data

Dec. 6, 2007 (JP) ..... 2007-315798

(51) Int. Cl.
*H05B 33/02* (2006.01)

(52) U.S. Cl. ..... 313/502; 313/503; 428/690

(58) Field of Classification Search ..... 313/502, 313/503; 428/690

See application file for complete search history.

(56) References Cited

U.S. PATENT DOCUMENTS

| | | | | |
|---|---|---|---|---|
| 6,180,029 | B1 * | 1/2001 | Hampden-Smith et al. | 252/301.4 R |
| 7,058,103 | B2 | 6/2006 | Ishida et al. | |
| 7,638,938 | B2 | 12/2009 | Aoyama et al. | |
| 2004/0023010 | A1 | 2/2004 | Bulovic et al. | |
| 2005/0274944 | A1 | 12/2005 | Jang et al. | |
| 2006/0043361 | A1 | 3/2006 | Lee et al. | |
| 2006/0152138 | A1 * | 7/2006 | Hori et al. | 313/503 |
| 2006/0152139 | A1 * | 7/2006 | Hsieh et al. | 313/503 |
| 2006/0192210 | A1 | 8/2006 | Miyazawa | |
| 2006/0214576 | A1 | 9/2006 | Takahashi et al. | |
| 2007/0103068 | A1 * | 5/2007 | Bawendi et al. | 313/506 |
| 2007/0190675 | A1 | 8/2007 | Yamazaki et al. | |
| 2007/0241662 | A1 | 10/2007 | Choi et al. | |

FOREIGN PATENT DOCUMENTS

| | | |
|---|---|---|
| JP | 2004-83653 | 3/2004 |
| JP | 2005-038634 | 2/2005 |
| JP | 2005-522005 | 7/2005 |
| JP | 2005-228936 | 8/2005 |
| JP | 2005-353595 | 12/2005 |

(Continued)

*Primary Examiner* — Sikha Roy
*Assistant Examiner* — Steven Horikoshi
(74) *Attorney, Agent, or Firm* — Hamre, Schumann, Mueller & Larson, P.C.

(57) ABSTRACT

A light emitting device (10) of the present invention includes luminescent particles (14) and a pair of electrodes (12, 16) for injecting an electric current into the luminescent particles (14). An inorganic hole transport material (15) is disposed between the electrodes (12, 16). The luminescent particles (14) are dispersed in the inorganic hole transport material (15). Conductive fine particles may be adhered to at least a part of the surfaces of the luminescent particles (14) for the purpose of achieving further high brightness and high efficiency.

1 Claim, 6 Drawing Sheets

FOREIGN PATENT DOCUMENTS

| | | |
|---|---|---|
| JP | 2006-66395 | 3/2006 |
| JP | 2006-127884 | 5/2006 |
| JP | 2006-237403 | 9/2006 |
| JP | 2006-269382 | 10/2006 |
| JP | 2007-242604 | 9/2007 |
| JP | 2007-287662 | 11/2007 |

* cited by examiner

LIGHT EMITTING DEVICE HAVING INORGANIC LUMINESCENT PARTICLES IN INORGANIC HOLE TRANSPORT MATERIAL

TECHNICAL FIELD

The present invention relates to light emitting devices and display devices using the same.

BACKGROUND ART

In recent years, many kinds of flat type display devices have been proposed and are put in practical use. Among them, display devices using electroluminescence (hereinafter abbreviated as "EL") devices as a light emitting device of the surface-emitting type have received attention because of their usefulness. The EL devices are used as a backlight in liquid crystal displays or used for matrix type display devices in which the EL devices themselves are arranged in an array. For example, matrix type display devices using EL devices have good features such as self-luminosity, excellent visibility, wide view angle, and fast response. However, EL devices using organic materials as a luminescent material are insufficient in long-term reliability for the use in display devices. Furthermore, inorganic EL devices using inorganic materials as a luminescent material are insufficient in brightness and efficiency. Because of these and other reasons, the use of the EL devices is limited to specific applications.

Light emitting diodes (hereinafter abbreviated as "LED") put in practical use as a high brightness and high-efficiency light source also can be included in EL devices in a broad sense. The widespread use of the LEDs is now growing because the light emitting devices that emit high brightness blue light or high brightness green light have been developed. However, the LEDs are put in practical use only as a point light source, and use of the LEDs in display devices is limited to a specific application such as a light source for a backlight in liquid crystal displays.

As a material of the LEDs, group 13 nitride semiconductors have received attention. The group 13 nitride semiconductors have a wide band gap and emit light in the range from the ultraviolet region to the visible light region in accordance with their compositions. Furthermore, the group 13 nitride semiconductors are direct transition type semiconductors and have an effective energy band structure as a light emitting material. However, gallium nitride (GaN), a typical example of the group 13 nitride semiconductors, has the disadvantage of a substrate material being restricted due to a difference in a lattice constant and a difference in a thermal expansion coefficient. Although sapphire substrates mostly are used, their lattice mismatch ratios are about 1000 times larger than those of other semiconductor devices, and the resultant threading dislocation density is five orders of magnitude higher. That is, the application to large-area display devices is still difficult in view of performance and in view of cost.

In order to overcome such drawbacks of the LEDs, techniques using particulate or columnar group 13 nitride semiconductors have been invented. These techniques were invented for the purpose of forming p-n junctions, p-i-n structures, multiple quantum well structures, etc. of good quality in a microcrystal level.

JP 2005-228936 A discloses a light emitting device in which a light emitting layer containing a columnar group 13 nitride semiconductor is formed between a pair of electrodes. FIG. 7 shows a schematic configuration of a light emitting device 70 using a columnar crystal (hereinafter referred to as nanocolumn) of GaN. The light emitting device 70 is formed by stacking a back electrode 72, nanocolumns 74 disposed so as to be embedded in an insulating layer 73, and a transparent electrode 75 in this order on a substrate 71. The nanocolumn 74 is GaN with a diameter of several nanometers to several tens of nanometers and is disposed in such a manner that its front end protrudes slightly from the insulating layer 73. The transparent electrode 75 and the back electrode 72 are connected to each other electrically via a power supply 76. When a voltage is applied using the power supply 76, holes are injected into the nanocolumns 74 from the transparent electrode 75 connected to the positive electrode, and electrons are injected into the nanocolumns 74 from the back electrode 72 connected to the negative electrode. When the hole and the electron injected into the nanocolumn 74 recombine in the nanocolumn 74, light of luminescence corresponding to the band gap of the p-n junction is emitted. Emitted light exits the light emitting device 70 from the transparent electrode 75 side.

JP 2005-353595 A discloses a light emitting device in which a light emitting layer containing a nanocrystal of a group 13-15 compound semiconductor, etc., a polymer hole transport layer, and an organic electron transport layer are sandwiched between a pair of electrodes. FIG. 8 shows a schematic configuration using a nanocrystal of a compound semiconductor such as GaN. The light emitting device 80 is formed by stacking an anode (transparent) 82, a polymer hole transport layer 83, a light emitting layer 84 containing a nanocrystal, an organic electron transport layer 85 and a cathode 86 in this order on the substrate 81. The light emitting layer 84 contains a compound semiconductor nanocrystal with a diameter of 3 nm to 30 nm. The anode 82 and the cathode 86 are connected electrically via a power supply 87. When a voltage is applied using the power supply 87, holes are injected into the light emitting layer 84 from the anode 82 through the polymer hole transport layer 83, and electrons are injected into the light emitting layer 84 from the cathode 86 through the organic electron transport layer 85. The hole and the electron injected into the light emitting layer 84 reach the compound semiconductor nanocrystal in the light emitting layer 84, and light of luminescence due to recombination is emitted. The emitted light exits the light emitting device 80 from the anode 82 side.

In general, holes and electrons should be injected efficiently into a particulate luminescent material such as a semiconductor particle in order to achieve efficient luminescence in LED. The conventional techniques mentioned above have the advantage of reducing the mismatch with a substrate (such mismatch is observed in the LEDs) and have the advantage of ease of enlargement, however, they have not reached a sufficient level as a display device in practical use in view of brightness and light emission efficiency.

DISCLOSURE OF THE INVENTION

The present invention has been achieved to solve the above-mentioned problems. An object of the present invention is to provide a light emitting device that easily can be made planar and can achieve high brightness, high efficiency and light emission at a low voltage by efficiently providing holes and electrons to a particulate luminescent material. Another object of the present invention is to provide a display device using such a light emitting device.

The light emitting device of the present invention is a light emitting device including luminescent particles; a pair of electrodes for injecting an electric current into the luminescent particles; and an inorganic hole transport material disposed between the electrodes. The luminescent particles are dispersed in the inorganic hole transport material.

Moreover, the present invention provides a display device including the above-mentioned light emitting device of the present invention.

The present invention can provide a light emitting device that easily can be made planar and that can achieve high brightness, high efficiency and light emission at a low voltage. Since the display device of the present invention includes such a light emitting device, the display device can achieve high brightness, high efficiency and low voltage drive capability.

BEST MODE FOR CARRYING OUT THE INVENTION

Figure 1:
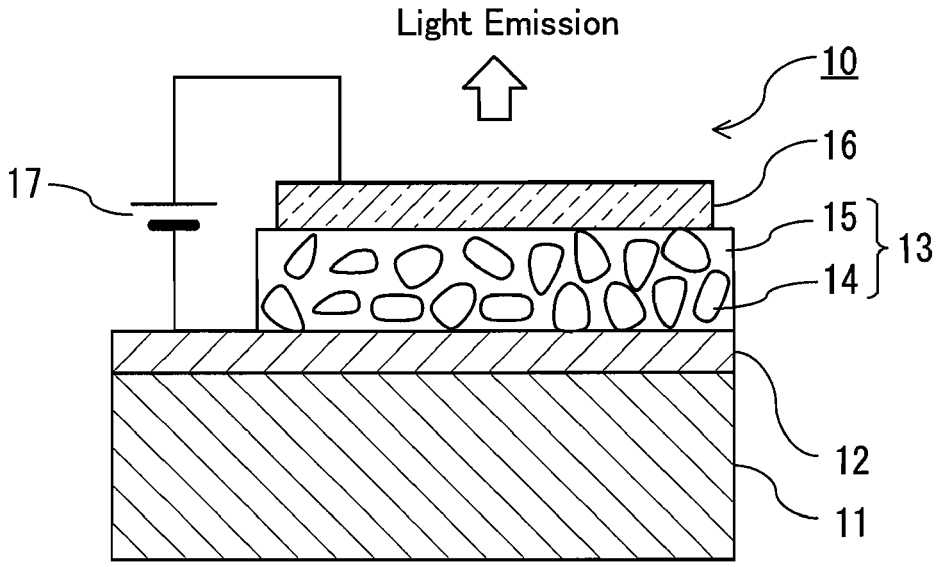
FIG. 1 is a sectional view showing an embodiment of the light emitting device of the present invention.

Hereinafter, embodiments of the present invention will be described with reference to the drawings. In some of the figures referenced in the description below, hatching may be omitted so that the figures can be viewed easily. Moreover, in the following description, the same parts may be indicated with identical reference numerals and the same description is not repeated in some cases.

(Embodiment 1)

An embodiment of the light emitting device according to the present invention is described with reference to FIG. 1. FIG. 1 is a sectional view showing a schematic configuration of the light emitting device according to this embodiment in a cross section taken perpendicular to a light emitting layer.

A light emitting device 10 of this embodiment includes luminescent particles 14, a back electrode 12 and a transparent electrode 16. The back electrode 12 and the transparent electrode 16 are a pair of electrodes that inject an electric current into the luminescent particles 14. The luminescent particles 14 are dispersed in an inorganic hole transport material 15 disposed between the back electrode 12 and the transparent electrode 16.

Specifically, the light emitting layer 13 composed of the inorganic hole transport material 15 and the luminescent particles 14 dispersed in the inorganic hole transport material 15 is sandwiched between a pair of electrodes, namely the back electrode 12 and the transparent electrode 16. This stack is supported by a substrate 11 disposed adjacent to the back electrode 12. The back electrode 12 and the transparent electrode 16 are connected electrically via a power supply 17. When electric power is supplied from the power supply 17, a voltage is applied between the back electrode 12 and the transparent electrode 16. At that time, electrons are injected from the back electrode 12 into the luminescent particles 14 in the light emitting layer 13, and holes are injected from the transparent electrode 16 into the luminescent particles 14 in the light emitting layer 13. The hole and electron injected into the luminescent particles 14 are recombined, and thereby light of luminescence with a wavelength corresponding to the band gap is emitted. The emitted light exits the light emitting device 10 through the transparent electrode 16. In this embodiment, a direct current power supply is used as the power supply 17. The light emitting device 10 of this embodiment is not limited to the above-mentioned structure and can be modified suitably. For example, part or all of the light emitting device 10 may be packaged with resins or ceramics; and a hole injection layer may be interposed between the transparent electrode 16 and the light emitting layer 13.

Figure 2:
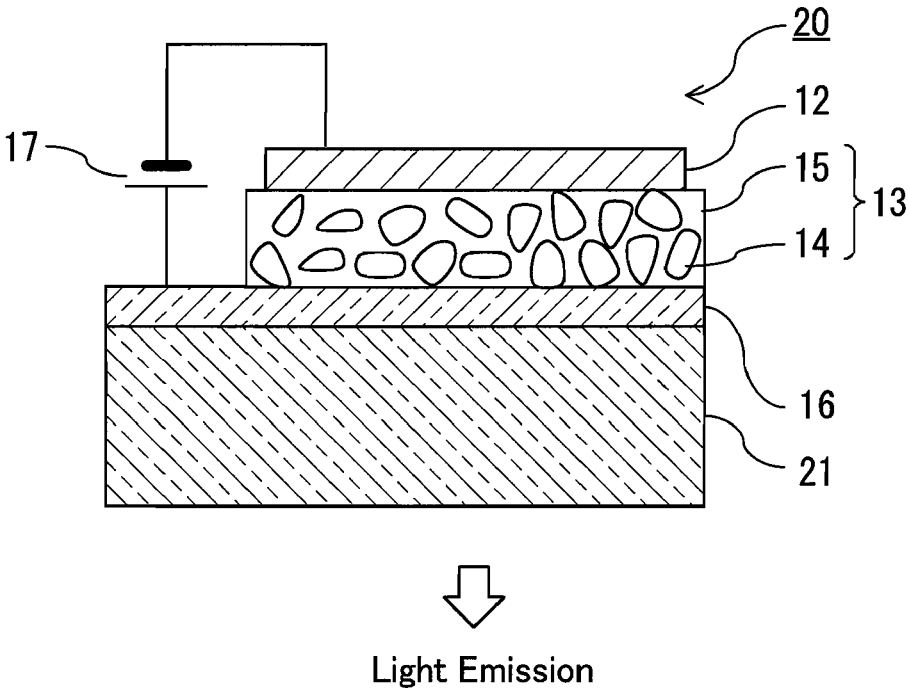
FIG. 2 is a sectional view showing another embodiment of the light emitting device of the present invention.

The structure of the light emitting device of this embodiment can be changed to a structure shown in FIG. 2. When compared with the light emitting device 10 shown in FIG. 1, a light emitting device 20 shown in FIG. 2 has a configuration in which the polarity of the electrodes (positive/negative) is reversed and a transparent substrate 21 is disposed adjacent to the transparent electrode 16. In the light emitting device 20, the light emitted from the light emitting layer 13 exits the device through the transparent electrode 16 and the transparent substrate 21.

Hereafter, components of the light emitting devices 10 and 20 are described in detail.

<Electrode>

The material of the transparent electrode 16 through which the light exits is not particularly limited as long as it is transparent to the light emitted from the light emitting layer 13, and the material preferably has high transmittance, especially in a visible light range. Moreover, the material preferably has low resistivity and preferably has good adhesion to the light emitting layer 13. Preferred examples of the material of the transparent electrode 16 include: metal oxides composed mostly of ITO ($In_2O_3$ doped with $SnO_2$, also referred to as indium tin oxide), InZnO, ZnO, $SnO_2$, etc.; metals such as Pt, Au, Pd, Ag, Ni, Cu, Al, Ru, Rh, and Ir; and conductive polymers such as polyaniline, polypyrrole, PEDOT/PSS (Poly(3,4-ethylenedioxythiophene)/Poly(styrene sulfonate)), and polythiophene. However, the material of the transparent electrode 16 is not limited to the above materials and can be selected from desired materials. Materials not having sufficient transparency (e.g., above-mentioned metals) also can be used to form an electrode with adequate transparency as the transparent electrode 16 when the thickness of the material is tens of nanometers or less. Alternatively, the transparent electrode 16 may be formed by a method in which an electrode made of the transparent material mentioned above is formed first and then an auxiliary electrode made of a material (which may not be transparent) that has lower resistivity than the transparent material is formed along the electrode. The method of forming the electrode is not particularly limited, and known methods can be used. For example, an ITO film can be deposited using a method (e.g., sputtering, electron beam evaporation, or ion plating) that is selected in accordance with the requirement, such as improvement in transparency or reduction in resistibility. Moreover, deposited film may be subjected to a surface treatment, such as a plasma treatment, for the purpose of controlling resistibility. The thickness of the transparent electrode 16 is not particularly limited and preferably is determined in accordance with required values of sheet resistance and visible light transmittance.

On the other hand, it is desirable for the back electrode 12 to be made of a material that is electrically conductive and exhibits good adhesion to both the substrate 11 and the light emitting layer 13. For example, metals such as Pt, Au, Pd, Ag, Ni, Cu, Al, Ru, Rh, and Ir can be used. The back electrode 12 may serve as a black electrode.

<Light Emitting Layer>

The light emitting layer 13 is formed by dispersing the luminescent particles 14 in the inorganic hole transport material 15. AlN, GaN, InN, AlP, GaP, InP, AlAs, GaAs, and AlSb, which are group 13-15 compound semiconductors, can be used for the luminescent particles 14. In other words, the luminescent particles 14 may contain the group 13-15 compound semiconductor or may consist of the group 13-15 compound semiconductor. For example, the luminescent particles 14 may contain a nitride semiconductor containing at least one element selected from the group consisting of Ga, Al, and In. In particular, the group 13 nitride semiconductors (typically GaN) are preferred, and mixed crystal thereof (e.g., GaInN, etc.) may be used. Among them, particles made of a GaN-based semiconductor (GaN-based semiconductor particles) preferably are used. A GaN-based semiconductor is a nitride semiconductor containing gallium (Ga) atom. Specifically, examples of the GaN-based semiconductors include gallium nitride (GaN), indium-gallium nitride mixed crystal (InGaN), aluminum-gallium nitride mixed crystal (AlGaN), indium-aluminum-gallium nitride mixed crystal (InAlGaN), etc. Furthermore, the GaN-based semiconductor may include one dopant element or a plurality of dopant elements selected from the group consisting of Si, Ge, Sn, C, Be, Zn, Mg, Ge, and Mn in order to control the conductivity. Furthermore, these compositions may form a layered structure or segregation structure in the luminescent particle 14. The average particle diameter of the luminescent particles 14 is, for example, from 0.1 μm to 100 μm, and preferably is from 0.5 μm to 50 μm. The particle diameter of the luminescent particle 14 is represented by an equivalent light-scattering diameter measured using a laser diffraction/scattering method. The average particle diameter is represented by a particle diameter at which the cumulative percentage in diameter-number distribution reaches 50%.

Next, the inorganic hole transport material 15, which is a matrix material filling the space between the luminescent particles 14, is described. As the inorganic hole transport material 15, an inorganic material that is transparent or translucent and that exhibits p-type conductivity (e.g., p-type semiconductor material) can be used. Preferred examples include: semimetal-based semiconductors such as Si, Ge, SiC, Se, SeTe, and $As_2Se_3$; binary compound semiconductors such as ZnSe, CdS, ZnO, and CuI; chalcopyrite semiconductors such as $CuGaS_2$, $CuGaSe_2$, and $CuInSe_2$, and mixed crystals thereof and oxide semiconductors such as $CuAlO_2$ and $CuGaO_2$, and mixed crystals thereof. For example, SiC, amorphous Se (a-Se), etc. preferably are used when GaN-based semiconductor particles are used as the luminescent particles 14. Furthermore, a dopant may be doped into these materials in order to control conductivity.

Next, a method of forming the light emitting layer 13 is described. In an example of the method, the luminescent particles 14 are deposited on the back electrode 12 (dispersion arrangement) in advance, and then the inorganic hole transport material 15 is deposited using a sputtering method (downward deposition), thereby forming the light emitting layer 13. Alternatively, the light emitting layer 13 can be formed using another method suitably selected from: a spray coating method in which the luminescent particles 14 and the inorganic hole transport material 15 are sprayed at one time; a sol gel method in which a layer is formed by mixing the luminescent particles 14 with a sol solution of a precursor of the inorganic hole transport material; a method in which a mixture of the luminescent particles 14 and a glass frit that is to be the inorganic hole transport material is applied and sintered; a thermal barrier coating, etc.

In the light emitting devices 10 and 20 of this embodiment, the light emitting layer 13 is formed by dispersing the luminescent particles 14 in the inorganic hole transport material 15. Since the space between the luminescent particles 14 is filled with the inorganic hole transport material 15 having higher hole mobility than organic materials, the luminescent particles 14 efficiently and sufficiently are supplied with holes, thereby achieving light emission of high brightness and high efficiency. In the case where light is emitted by electric current excitation as is the case with the light emitting device of the present invention, heat generation due to, for example, a contact resistance between the light emitting layer 13 and the electrode has been acknowledged as a problem. However, the use of the inorganic hole transport material 15 can allow the device to be more reliable compared to the use of organic materials.

(Embodiment 2)

Figure 3:
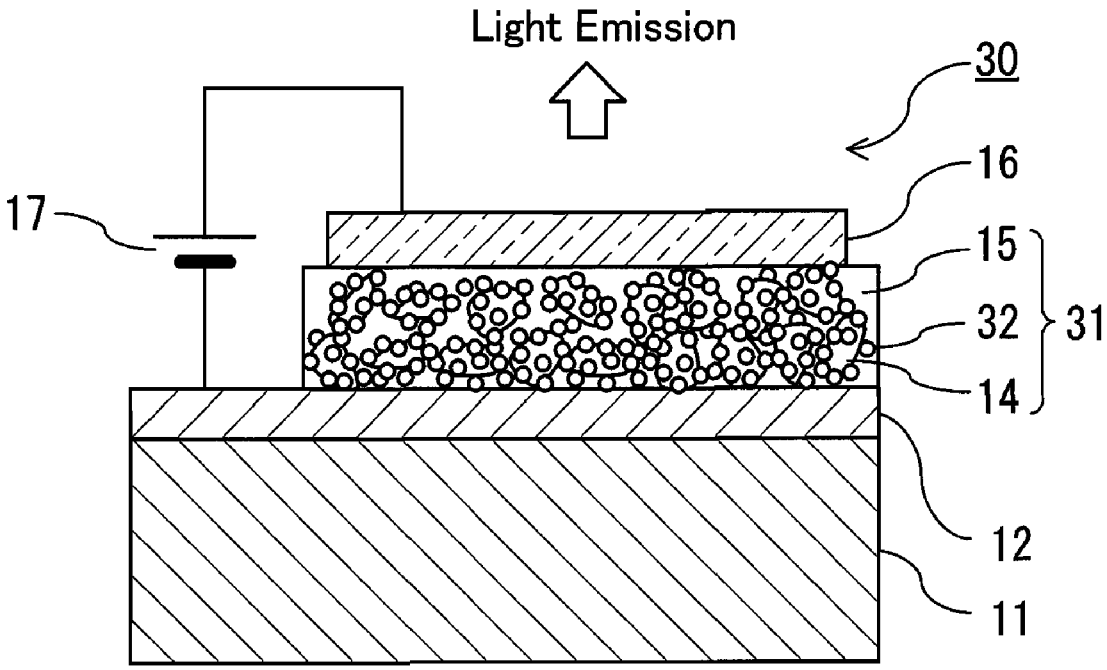
FIG. 3 is a sectional view showing still another embodiment of the light emitting device of the present invention.

Another embodiment of the light emitting device according to the present invention is described with reference to FIG. 3. FIG. 3 is a sectional view showing a schematic configuration of the light emitting device according to this embodiment in a cross section taken perpendicular to a light emitting layer.

Since a light emitting device 30 of this embodiment is the same as the light emitting device 10 of Embodiment 1 except for a light emitting layer 31, only the light emitting layer 31 is described below.

The light emitting layer 31 is formed by dispersing the luminescent particles 14 in the inorganic hole transport material 15. Conductive fine particles 32 are adhered to at least a part of the surfaces of the luminescent particles 14.

In order to prevent the conductive fine particle 32 from blocking the light emitted from the luminescent particle 14, the conductive fine particle 32 can be made of a conductive material that transmits the light emitted from the luminescent particle 14. Preferred examples of the conductive material include: $In_2O_3$, ZnO, $SnO_2$, etc. and mixed crystal thereof composite oxide (e.g., ITO, IZO (indium zinc oxide)); and nitrides such as TiN. Moreover, Ga, Al, etc. may be added (e.g., GZO (gallium zinc oxide) and AZO (aluminum zinc oxide)). For example, ITO, IZO, etc. preferably are used as the conductive fine particles 32 when GaN particles are used as the luminescent particles 14. The average particle diameter of the conductive fine particles 32 is, for example, from 1 nm to 100 nm, and preferably is from 5 nm to 50 nm. It should be noted that the average particle diameter of the conductive fine particles 32 is calculated in the same manner as the average particle diameter of the luminescent particles 14.

The light emitting layer 31 of this embodiment can be formed by, for example, the same method as that of forming the light emitting layer 13 of embodiment 1 except that the conductive fine particles 32 are added to and mixed with the luminescent particles 14 with a regulated particle size, thereby allowing the conductive fine particles 32 to be adhered to the surfaces of the luminescent particles 14 in advance.

In the light emitting device 30 of this embodiment, the conductive fine particles 32 are adhered to at least a part of the surfaces of the luminescent particles 14, and the conductive fine particles 32 are present between the luminescent particles 14. Since the conductive fine particles 32 can reduce the electric contact resistance between the luminescent particles 14, driving at an even lower voltage can be achieved. Moreover, holes and electrons efficiently can be injected into the luminescent particles 14 because the conductive fine particles 32 rarely cause a problem due to a leakage path as compared to a conductive film that completely covers the luminescent particle 14. Furthermore, since the conductive fine particle 32 having a particle diameter, for example, from 1 nm to 100 nm, easily can enter the space between the luminescent particles 14, the contact resistance can be reduced effectively even if the surface of the luminescent particle 14 is not smooth or even if the particle sizes of the luminescent particles 14 are not uniform.

(Embodiment 3)

Figure 4:
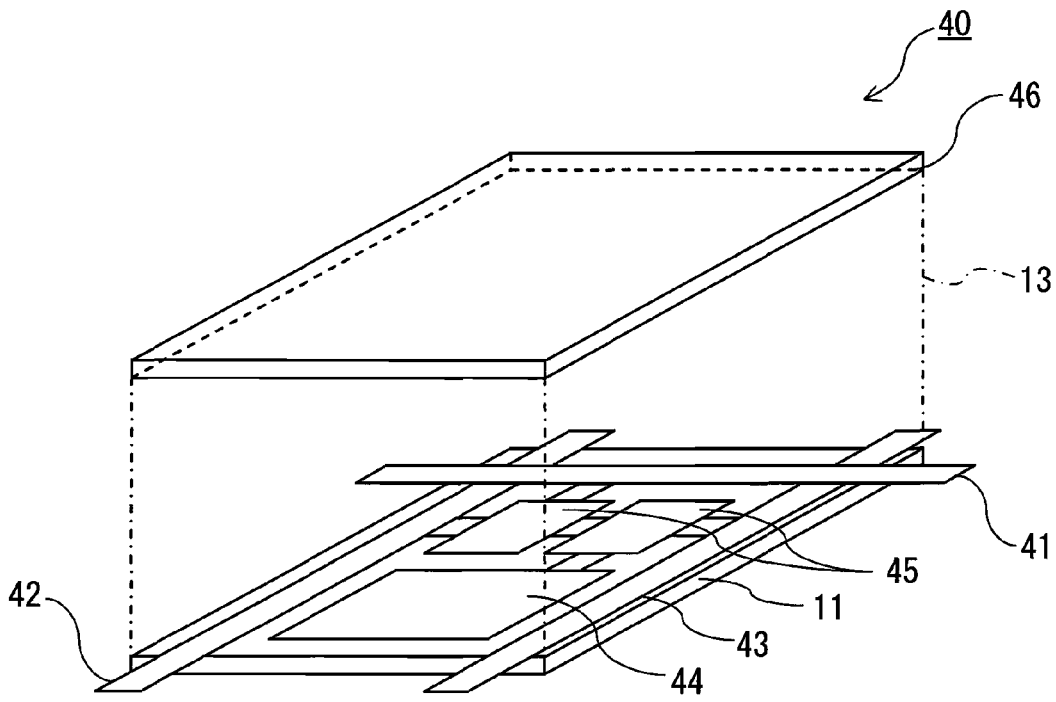
FIG. 4 is a perspective view showing yet another embodiment of the light emitting device of the present invention.

Another embodiment of the light emitting device according to the present invention is described with reference to FIG. 4. FIG. 4 is a perspective view showing a schematic configuration of the light emitting device according to this embodiment.

A light emitting device 40 of this embodiment includes a thin film transistor (hereinafter referred to as "TFT") 45 in addition to the light emitting devices 10 and 20 (see FIG. 1 and FIG. 2) described in Embodiment 1. In this embodiment, a switching TFT and a driving TFT are used as the TFTs 45.

In the light emitting device 40 of this embodiment, the light emitting layer 13 is disposed between a pixel electrode 44 and a common electrode 46, and this stack is supported by the substrate 11 disposed on the pixel electrode 44 side. Holes and electrons are injected into the light emitting layer 13 by applying a voltage between the pixel electrode 44 and the common electrode 46. A scan line 41, a data line 42, and a current supply line 43 are disposed on the substrate 11, and the TFTs 45 are connected with the lines 41-43. In the light emitting device 40, the emitted light exits from the common electrode 46 side, and the common electrode 46 is transparent to the light emitted from the light emitting layer 13.

Since the light emitting device 40 of this embodiment has the same structure as the light emitting devices 10 and 20 of Embodiment 1, the light emitting device 40 can achieve high brightness, high efficiency, and light emission at a low voltage. Furthermore, since the light emitting device 40 emits light from the common electrode 46 side, the aperture ratio can be made larger regardless of how the TFTs 45 are arranged on the substrate 11. Moreover, the TFTs 45 can allow the light emitting device 40 to have a memory function. Low temperature polysilicon TFTs; amorphous silicon TFTs; organic TFTs composed of organic materials such as pentacene; inorganic TFTs composed of ZnO, $InGaZnO_4$, etc. can be used as the TFT 45.

Since the light emitting layer 13 in the light emitting device 40 has the same function and structure as the light emitting layer 13 described in Embodiment 1, a detailed description thereof is omitted. In FIG. 4, the structure of the light emitting layer 13 is not shown in detail but indicated by an alternate long and short dash line in order to show clearly each components of the light emitting device 40. Furthermore, the light emitting layer 31 described in Embodiment 3 may be used in the light emitting device 40 in order to achieve driving at an even lower voltage.

(Embodiment 4)

Figure 5:
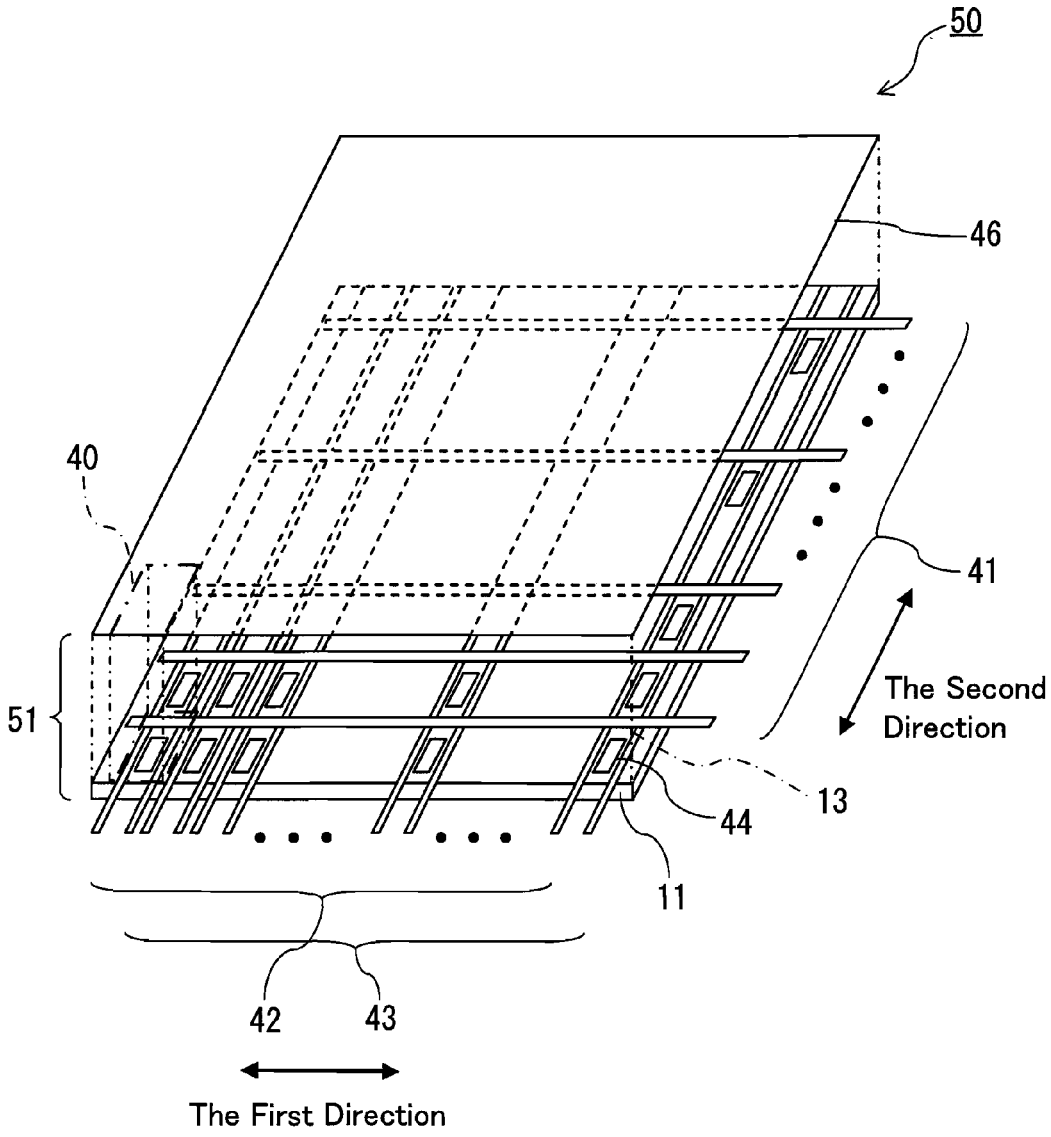
FIG. 5 is a perspective view showing an embodiment of the display device of the present invention.

An embodiment of the display device according to the present invention is described with reference to FIG. 5. A display device 50 of this embodiment includes a plurality of the light emitting devices of the present invention. In this embodiment, an active-matrix display device using a plurality of the light emitting devices described in Embodiment 3 is described.

A display device 50 includes: a light emitting device array 51 in which a plurality of the light emitting devices 40 shown in FIG. 4 are arranged two-dimensionally; a plurality of scan lines (the first electrodes) 41 arranged a distance apart from one another, each of the scan lines 41 extending along a first direction parallel to the plane of the light emitting device array 51; and a plurality of data lines (the second electrodes) 42 arranged a distance apart from one another, each of the data lines 42 extending along a second direction that is parallel to the plane of the light emitting device array 51 and crosses the first direction (crosses perpendicularly in this embodiment). Each of the TFTs (not shown) in the light emitting devices 40 is connected to one of the scan lines 41 and one of the data lines 42. The display device 50 further includes the current supply lines 43 arranged in parallel to the data lines 42. Each of the TFTs also is connected electrically to the current supply line 43.

Each of the light emitting devices 40 specified by one of the scan lines 41 and one of the data lines 42 constitutes one pixel. In the active-matrix display device 50, a pixel specified by one of the scan lines 41 and one of the data lines 42 is supplied with a current from the current supply line 43 through the TFT 45, thereby driving the specified light emitting device 40. The emitted light thus obtained exits from the transparent common electrode 46 side.

Since the light emitting devices 40 are used in the active-matrix display device 50, a display device of high brightness, high efficiency and low-voltage driving can be realized as described in Embodiment 3.

In the case of a color display device, the light emitting layer may be formed to have different colored regions using the luminescent particles corresponding to each of the RGB colors. Alternatively, light emitting units each having a layered structure of electrode/light emitting layer/electrode may be formed for each of the RGB colors. In another embodiment of a color display device, an RGB display can be realized by a process in which a display device having a light emitting layer of a single color or two colors is fabricated and then a color filter and/or a color conversion filter (color conversion layer) is disposed on the light exit side. For example, an RGB display can be realized when blue light emitting layers are equipped with filters that convert blue light to green light and filters that convert blue or green light to red light.

(Embodiment 5)

Figure 6:
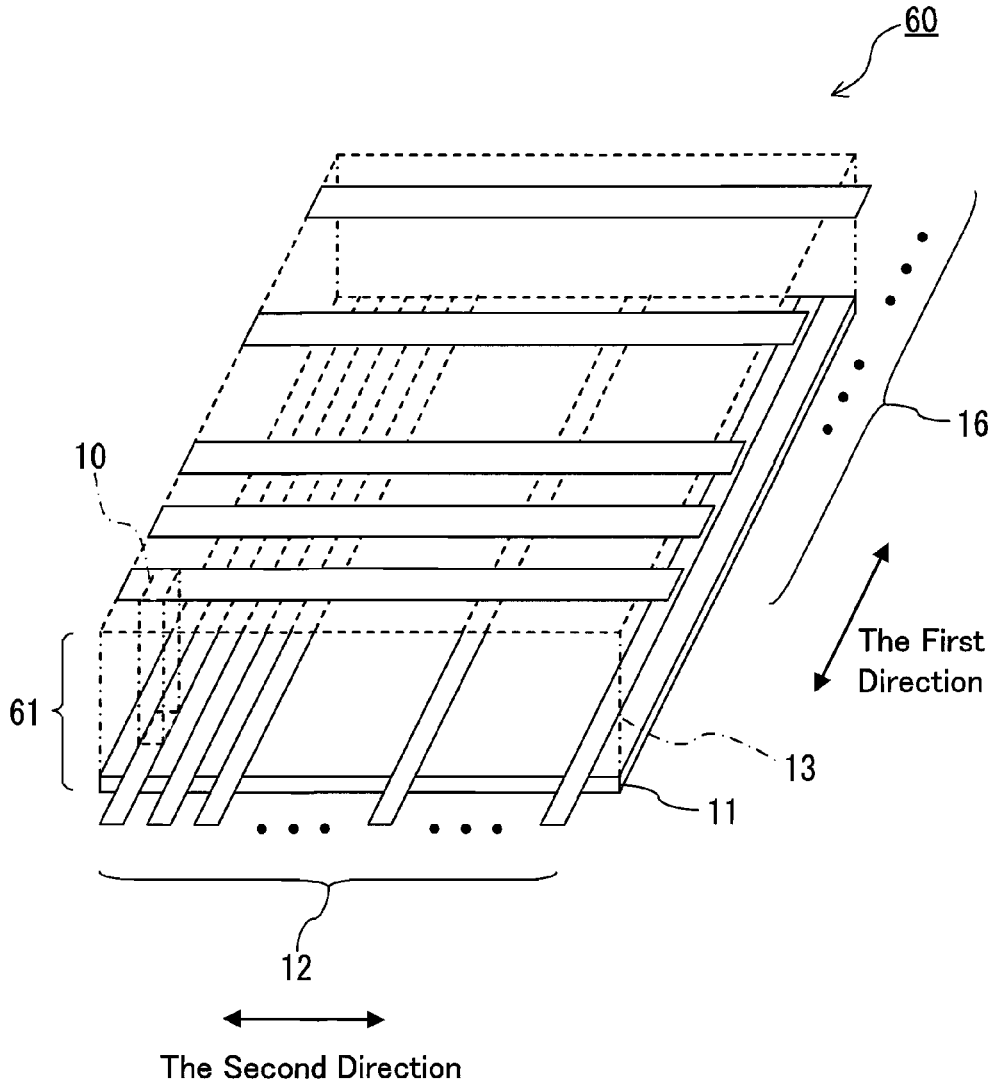
FIG. 6 is a perspective view showing another embodiment of the display device of the present invention.
Figure 7:
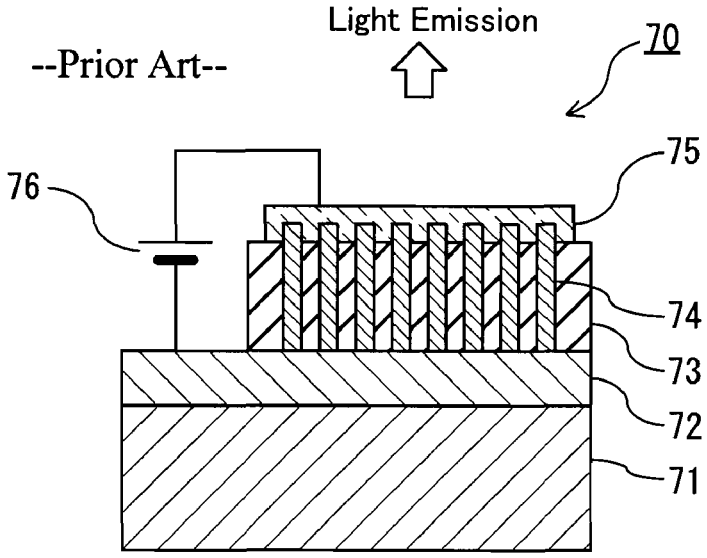
FIG. 7 is a sectional view showing an example of the conventional light emitting device.
Figure 8:
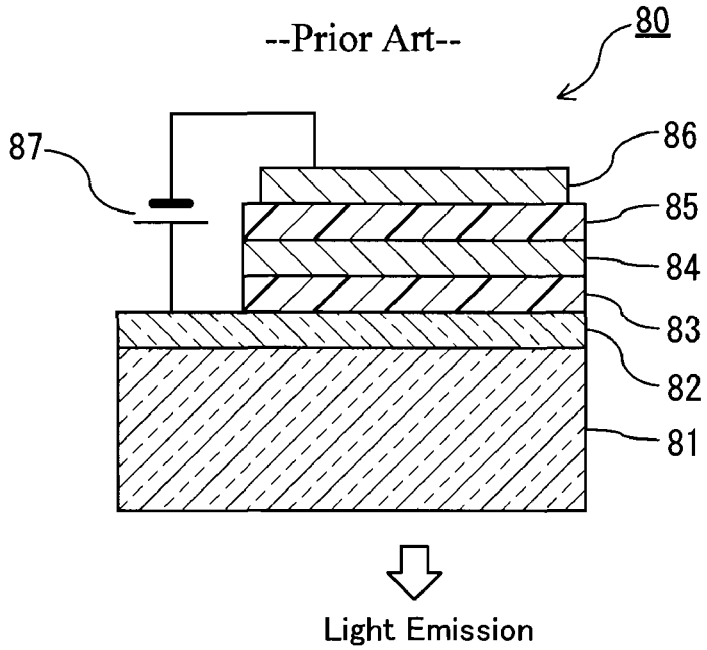
FIG. 8 is a sectional view showing another example of the conventional light emitting device.

Another embodiment of the display device according to the present invention is described with reference to FIG. 6. A display device 60 of this embodiment includes a plurality of the light emitting devices of the present invention. The display device 60 is a passive-matrix display device including the light emitting devices 10 described in Embodiment 1.

The display device 60 includes: a light emitting device array 61 in which a plurality of the light emitting devices 10 are arranged two-dimensionally; a plurality of back electrodes (the first electrodes) 12 arranged a distance apart from one another, each of the back electrodes 12 extending along a first direction parallel to the plane of the light emitting device array 61; and a plurality of transparent electrodes (the second electrodes) 16 arranged a distance apart from one another, each of the transparent electrodes 16 extending along a second direction that is parallel to the plane of the light emitting device array 61 and crosses the first direction (crosses perpendicularly in this embodiment). In this embodiment, the back electrode 12 and the transparent electrode 16 serve as both a pair of electrodes that constitute the light emitting device 10 and the first and second electrodes in the display device of the present invention. Thus, each of the light emitting devices 10 is connected electrically to one of the first electrodes and one of the second electrodes. In the display device 60, one of the light emitting devices 10 is driven by applying a voltage between one of the back electrodes 12 and one of the transparent electrodes 16, and the resultant emitted light exits from the transparent electrode 16 side.

The display device 60 can achieve high brightness, high efficiency, and low voltage drive as well as the display device of Embodiment 4. Moreover, the display device 60 can be a color display device in the same manner as the display device of Embodiment 4.

Although the light emitting device shown in FIG. 1 is used in this embodiment, the light emitting devices shown in FIG. 2 and FIG. 3 can, of course, be used.

EXAMPLES

Hereinafter, the present invention is described further in detail with reference to Examples and Comparative Examples. However, the present invention is not limited to the following examples as long as the invention is within the scope of the preset invention.

Example 1

A light emitting device having the same structure as the light emitting device 10 shown in FIG. 1 was fabricated as a light emitting device of Example 1.

First, $Ga_2O_3$ was allowed to react in an ammonia atmosphere at 1000° C. for 3 hours, thereby preparing GaN particles as luminescent particles. The average particle diameter of the resultant GaN particles was 2 μm.

Next, the GaN particles thus obtained and a paste containing SiC fine particles (average particle diameter: 5 nm) used as an inorganic hole transport material were kneaded at a volume ratio of 1:1. The paste was a mixture in which the SiC fine particles and a binder ("EL binder" made by Saitama Yakuhin Co. Ltd.) were mixed at the volume ratio of 1:1. The light emitting layer was formed using the kneaded mixture in which the GaN particles were dispersed. Specifically, the light emitting layer was formed by applying the kneaded mixture of the GaN particles and the SiC fine particles on an ITO electrode of a glass substrate with the ITO electrode using a slit coating method. Next, another glass substrate with an ITO electrode was provided and was placed on the light exit side. Thus, a light emitting device in which the light emitting layer was sandwiched between a pair of the ITO electrodes was fabricated. When a direct current voltage was applied to the device using "PAR36-3H" made by Kenwood Corp. to evaluate its light emission performance, the device emitted light at 15 V. The brightness of the device was 1.3 times higher than that of Comparative Example 1 mentioned below. The brightness was measured using a luminance meter "LS-110" made by Konica Minolta Holdings, Inc.

Comparative Example 1

A light emitting device of Comparative Example 1 was fabricated in the same manner as described in Example 1 except that an organic hole transport material (a tetraphenyl butadiene derivative, "T-770" made by TAKASAGO INTERNATIONAL CORP.) was used instead of the inorganic hole transport material. When a direct current voltage was applied to the device in the same manner as described in Example 1 to evaluate its light emission performance, the device emitted light at 16 V.

Example 2

A light emitting device of Example 2 having the same structure as the light emitting device 30 shown in FIG. 3 was fabricated.

First, $Ga_2O_3$ was allowed to react in an ammonia atmosphere at 1000° C. for 3 hours, thereby preparing GaN particles as luminescent particles. The average particle diameter of the resultant GaN particles was 2 μm. An ITO nano paste ("X-105" made by SUMITOMO METAL MINING CO., LTD., average particle diameter of ITO fine particles: 50 nm) was used for the conductive fine particles. The ITO nano paste and the GaN particles were kneaded at 1:1 (volume ratio) so that the conductive fine particles made of ITO were adhered to the surfaces of the GaN particles.

Next, the resultant GaN particles to which the conductive fine particles were adhered and a paste containing, as a main component, SiC fine particles (average particle diameter: 5 nm) used as an inorganic hole transport material were kneaded at a volume ratio of 1:1. The paste was a mixture of the SiC fine particles and a binder ("EL binder" made by Saitama Yakuhin Co. Ltd.). The light emitting layer was formed using the kneaded mixture in which the GaN particles were dispersed. Specifically, the light emitting layer was formed by applying the kneaded mixture of the GaN particles and the SiC fine particles on an ITO electrode of a glass substrate with the ITO electrode using a slit coating method. Next, another glass substrate with an ITO electrode was provided and was placed on the light exit side. Thus, a light emitting device in which the light emitting layer was sandwiched between a pair of the ITO electrodes was fabricated. When a direct current voltage was applied to the resultant device in the same manner as described in Example 1 to evaluate its light emission performance, the device emitted light at 8 V. The brightness of the device was 1.8 times higher than that of Comparative Example 2 mentioned below.

Example 3

GaN particles to which the conductive fine particles were adhered were prepared in the same manner as described in Example 2. Next, the GaN particles were dispersed on a surface of a Si substrate except for an electrode pad bonding region. At that time, detachment of the GaN particles from the substrate was prevented using the planarization material (inorganic SOG, "HSG-255" made by Hitachi Chemical Co., Ltd.) that is generally used for forming interlayer dielectric films. Next, Se was evaporated on the resultant GaN particles layer to constitute a matrix portion (inorganic hole transport material) made of a-Se between the GaN particles, thereby forming a light emitting layer. Next, an ITO electrode was formed on the light emitting layer using a sputtering method. Thus, a light emitting device was obtained. When a direct current voltage was applied to the resultant device in the same manner as Example 1 to evaluate its light emission performance, the device emitted light at 11 V. The brightness of the device was 1.7 times higher than that of Comparative Example 2 mentioned below.

Comparative Example 2

A light emitting device of Comparative Example 2 was fabricated in the same manner as described in Example 2 except that an organic hole transport material (tetraphenyl butadiene derivative, "T-770" made by TAKASAGO INTERNATIONAL CORP.) was used instead of the inorganic hole transport material. When a direct current voltage was applied to the resultant device in the same manner as Example 1 to evaluate its light emission performance, the device emitted light at 10 V.

As described above, the light emitting device of the present invention that has a light emitting layer in which luminescent particles are dispersed in an inorganic hole transport material can emit brighter light than the light emitting device using an organic hole transport material when driven at the same voltage.

INDUSTRIAL APPLICABILITY

The light emitting device of the present invention can emit light at a low voltage and can emit light of high brightness and high-efficiency. In particular, it is useful as the light emitting device used in display devices (television, etc.) or as various light sources used for communications, lightings, etc. Moreover, the display device of the present invention can be used as various display devices because it can achieve a display of high brightness, high efficiency, and low voltage drive.

The invention claimed is:

1. A light emitting device comprising:

a light emitting layer including:

luminescent particles containing a group 13-15 compound semiconductor;

an inorganic hole transport material exhibiting a p-type conductivity; and conductive fine particles adhered to at least a part of surfaces of the luminescent particles; and a pair of electrodes disposed to sandwich the light emitting layer for injecting an electric current into the luminescent particles;

wherein the luminescent particles are dispersed in the inorganic hole transport material, the luminescent particles have an average particle diameter of 0.1 μm to 100 μm, and the conductive fine particles have an average particle diameter of 1 nm to 100 nm.

* * * * *